US006116898A

United States Patent [19]

Frechette

[11] Patent Number: 6,116,898

[45] Date of Patent: Sep. 12, 2000

[54] OVEN HAVING BUILT-IN GAS BIASING MEANS

[76] Inventor: Gaston Frechette, 1778 chemin du Fleuve, St-Romuald, Quebec, Canada, G6W 1Z8

[21] Appl. No.: 09/398,531

[22] Filed: Sep. 16, 1999

[30] Foreign Application Priority Data

Sep. 16, 1998 [GB] United Kingdom ..... 9820048

[51] Int. Cl.[7] ..... F27B 3/22

[52] U.S. Cl. ..... 432/196; 432/197; 432/249; 34/168; 34/218; 202/88

[58] Field of Search ..... 432/9, 28, 90, 432/156, 178, 194, 196, 197, 215, 217, 218, 249; 34/86, 168, 169, 174, 175, 210, 218, 233, 395, 396; 202/88

[56] References Cited

U.S. PATENT DOCUMENTS

| | | | |
|---|---|---|---|
| 2,798,716 | 7/1957 | Pugh | 432/249 |
| 3,633,886 | 1/1972 | Froberg | 432/179 |
| 3,848,344 | 11/1974 | Kemmetmueller | 432/90 |
| 4,914,834 | 4/1990 | Sime | 34/169 |
| 5,915,814 | 6/1999 | Crews | 34/168 |

*Primary Examiner*—Denise L. Ferensic
*Assistant Examiner*—Gregory A. Wilson
*Attorney, Agent, or Firm*—Eric Fincham

[57] ABSTRACT

An oven which has a floor, a side wall extending upwardly therefrom to define a combustion chamber, and a top having an opening for combustion gases, a fuel support member mounted in a lower part of the combustion chamber, the fuel support member having a raised central portion with a downwardly and outwardly sloping top surface extending therefrom, and means for supplying fuel to the fuel support member. The oven includes an arrangement for providing primary air to the fuel on the fuel support member and for providing secondary air to an upper portion of the combustion chamber, the secondary air being arranged to impart a cyclonic motion to the combustion gases.

12 Claims, 4 Drawing Sheets

OVEN HAVING BUILT-IN GAS BIASING MEANS

The present invention relates to an oven and more particularly, relates to an oven for generating hot air which may be used for drying.

BACKGROUND OF THE INVENTION

In the field of forestry, the tree or log is subjected to a variety of operations before the final product of dimensioned lumber is obtained. Once the dimensioned lumber has been cut from the log, it is then normally subjected to a drying operation to remove moisture from the lumber. As will be appreciated, a substantial amount of moisture must be removed from the lumber and to do so requires substantial energy input.

Conventionally, the lumber is dried using various wastes from the sawmill and other associated steps as a fuel. Thus, one can use sawdust, wood chips, various pulping wastes, and the like as a source of fuel for heating the air for subsequently drying the lumber.

There are different types of commercially available ovens which are used for such wood drying operations. Normally they utilize a screw conveyor feeding into a combustion chamber wherein air is fed from underneath to the fuel. Such air is known as the primary air and is used for the combustion of the fuel. Subsequently, there may be provided secondary air to assist in the more complete combustion. However, despite the above, it has been found that there is not as complete a combustion as would be desired and therefore, energy is wasted.

SUMMARY OF THE INVENTION

It is an object of the present invention to provide an oven wherein a more complete combustion is achieved and energy efficiencies are maximized.

It is a further object of the present invention to provide an oven wherein a cyclonic flow is provided.

According to one aspect of the present invention, there is provided an oven comprising a floor, an oven side wall extending upwardly therefrom to define a combustion chamber, and a top having an opening for combustion gases; a fuel support member for receiving fuel mounted in a lower part of the combustion chamber, the fuel support member having a raised central portion, a downwardly and outwardly sloping top surface extending from the raised central portion; means for feeding fuel to the fuel support member; means for providing primary air to the fuel on the fuel support member; and means for providing secondary air to an upper portion of the combustion chamber, the means for providing secondary air being arranged to impart a cyclonic motion to the secondary air.

In a preferred embodiment of the invention, the means for providing secondary air comprises a plurality of somewhat tangential conduits formed in the oven side wall. The number of conduits and their sizing will depend upon the size of the oven and may be established by those knowledgeable in the art.

Preferably, the tangential conduits extend from an outer surface of the oven side wall to an inner surface which surrounds the combustion chamber, the conduits being angled downwardly from the outer surface of the oven side wall to the inner surface of the oven side wall.

The oven also preferably includes means for providing primary air to the fuel on the fuel support member such that a cyclonic motion is imparted to the combustion gases. The means for imparting a cyclonic motion to the combustion gases may comprise a plurality of conduits formed in the top wall of the fuel support member, the conduits being angled with respect to a vertical plane. Alternatively, and/or in conjunction with the above, primary air may be provided through a plurality of tangential conduits in the oven side wall. Either or both of these embodiments may be employed—for example, one could use the tangential conduits with vertical conduits in the base support in the top wall of the fuel support member.

The fuel may be supplied to the top wall of the fuel support member by varying means. One such means includes the use of a screw conveyor to feed the fuel. Alternatively, the fuel may be provided by other feed means such as blowing the fuel to the desired location. Such would be practical when the fuel is sawdust, small wood chips, and the like. Naturally, any desired fuel can be used, either resulting from waste materials used in the logging or pulping process and/or to use of other conventional fuels.

Preferably, the outwardly and downwardly sloping top surface of the fuel support member terminates short of the oven side wall to provide a gap between the fuel support member and the oven side wall to permit ashes to fall therethrough.

Conveniently, the oven includes an outer wall surrounding the oven side wall, the outer wall being spaced from the oven side wall, and with dividers to form air ducts between the outer wall and the oven side wall. The ducts may be used to provide one or all of the primary air, secondary air and tertiary air.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
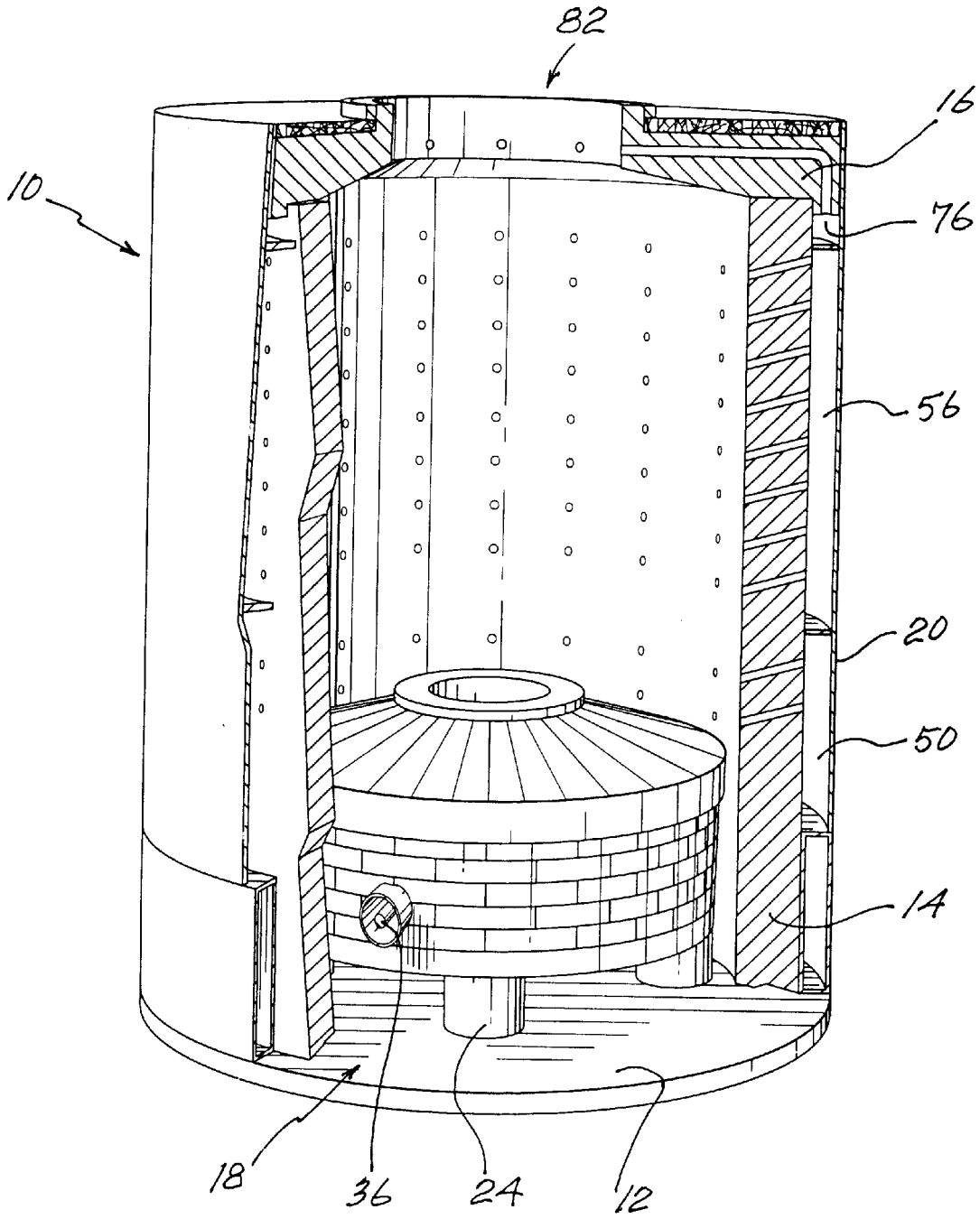
FIG. 1 is a perspective view, partially in cutaway, of an oven according to one embodiment of the present invention.

Referring to the drawings in greater detail and by reference characters thereto, there is illustrated in FIG. 1 an oven according to one embodiment of the present invention and which oven is generally designated by reference numeral 10.

Oven 10 is comprised of a floor 12 having an oven side wall 14 extending upwardly therefrom. A cover 16 is seated on the upper edge of oven side wall 14 while interiorly of oven side wall 14, which defines the combustion chamber, is a fuel support member generally designated by reference numeral 18. An outer wall 20 surrounds oven side wall 14 and is spaced therefrom for reasons which will become apparent hereinbelow.

Figure 2:
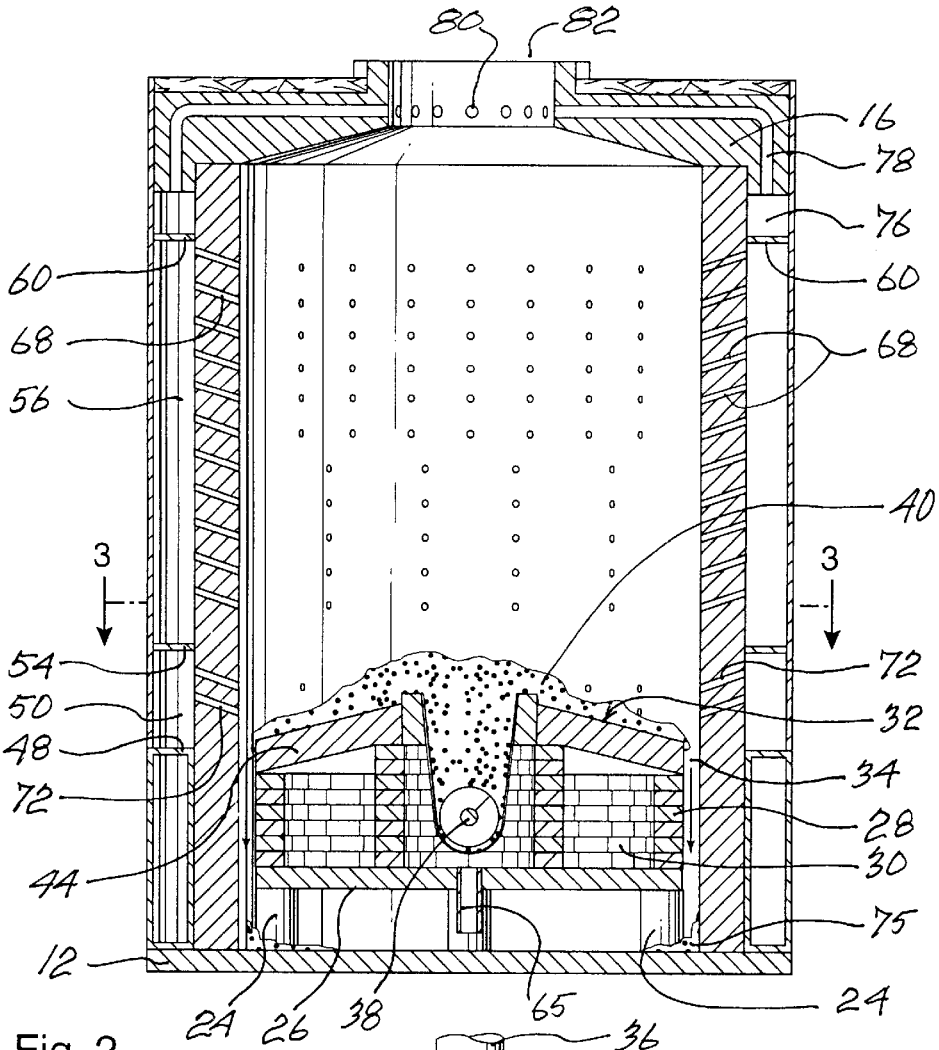
FIG. 2 is a side sectional view thereof.
Figure 3:
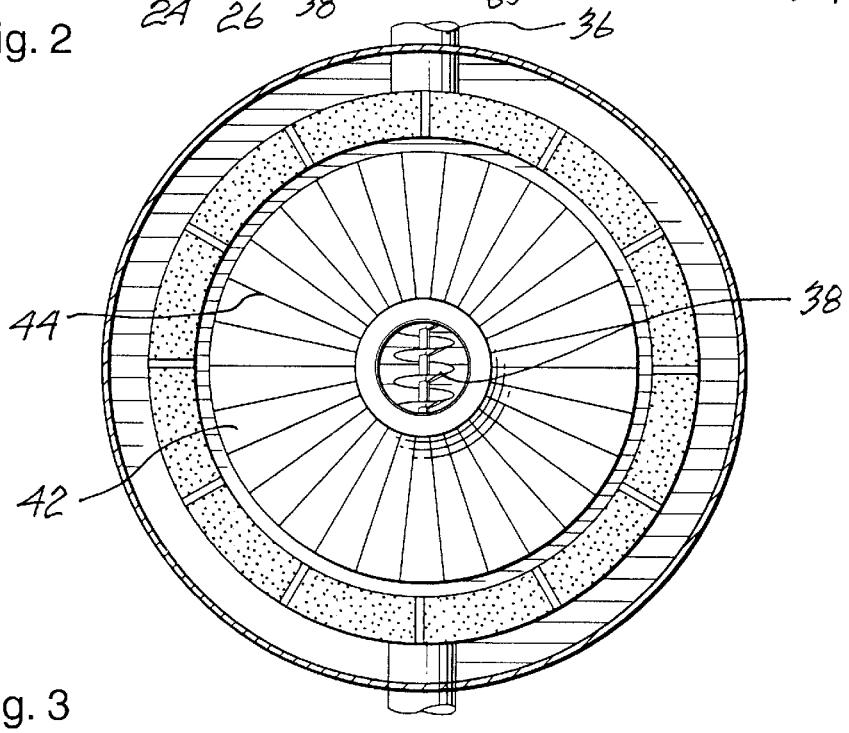
FIG. 3 is a cross sectional view taken along the line 3—3 of FIG. 2.
Figure 4:
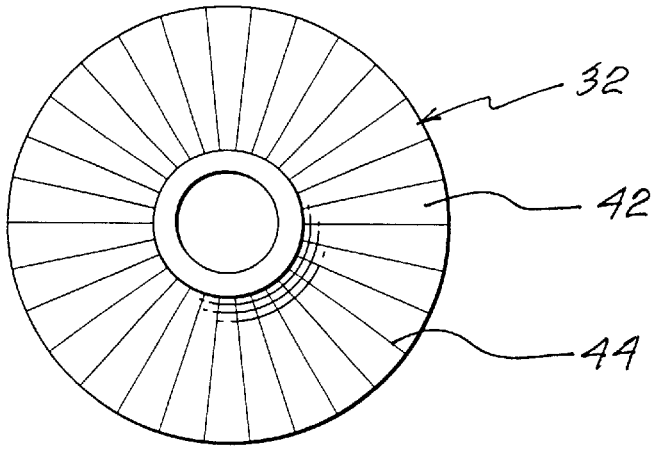
FIG. 4 is a top plan view of the fuel support member.
Figure 5:
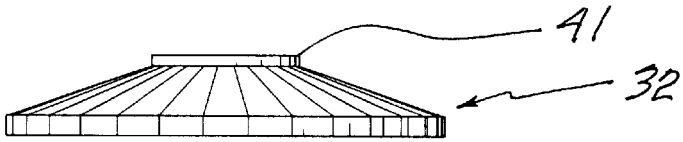
FIG. 5 is a side elevational view of the top wall thereof.
Figure 6:
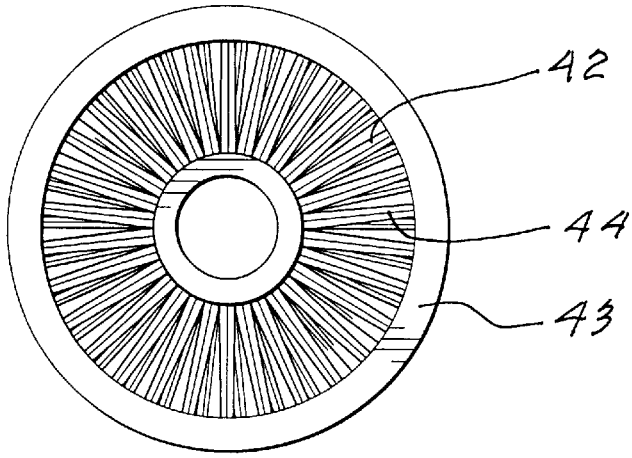
FIG. 6 is a bottom plan view thereof.
Figure 7:
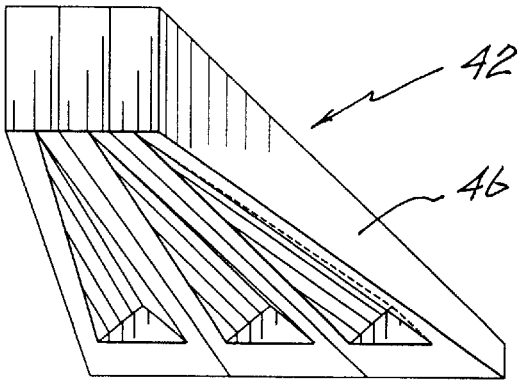
FIG. 7 is a view of one of the segments forming the top wall of the fuel support member.

Fuel support member 18, as may be best seen in FIGS. 1 and 2, is mounted on floor 12 by means of support legs 24.

Fuel support member 18 also has a fuel support bottom 26 and a fuel support side wall 28 to provide a generally hollow cavity. Fuel support side wall 28 may be formed of refractory brick 30. As may be seen in FIG. 2, there is also provided a fuel support top wall 32 which tapers downwardly and outwardly from a central portion to adjacent oven side wall 14, but terminating short thereof to provide a gap 34 between fuel support member 18 and oven side wall 14. An air inlet 65 is provided.

There is also provided a fuel conduit generally designated by reference numeral 36 and which extends transversely of the oven and through fuel support member 18. In the illustrated embodiment, fuel conduit 36 is provided with a screw conveyor 38 for providing fuel 40 to fuel support member 18.

As shown in more detail in FIGS. 4 to 7, top wall 32 of fuel support member 18 is formed of a plurality of wall segments 42, which have a tapered side wall 46 such that between adjacent segments, there are provided conduits or vents 44 which are at an angle relative to the vertical plane. Wall segments 42 are connected by means of an inner ring 41 and an outer ring 43.

As aforementioned, outer wall 20 surrounds oven side wall 14 and there is provided a bottom divider 48 extending between oven side wall 14 and outer wall 20. In conjunction with an upper divider 54, there is thereby defined a primary air duct 50 surrounding the exterior bottom surface of oven side wall 14.

Similarly, there is provided a further divider 60 which together with divider 54 defines a secondary air duct 56 extending thereabout. In the very upper portion, there is provided a further divider 62 which defines a tertiary air duct 64.

Extending from secondary air duct 56 through oven side wall 14 are a plurality of conduits of feed channels 68. Conduits 68 are arranged to be angled downwardly and somewhat tangentially to thereby impart a cyclonic motion to the air flow.

Similarly, there are provided primary air feed channels 72 extending between primary air duct 50 and proximate fuel support member 18. In this respect, primary air feed channels 72 may either be used in conjunction with the conduits or vents 44 formed in top wall 32. Thus, either may be used alone or they may be used in combination if desired to impart the desired flow to the air.

Located above divider 60 and defined by the area between cover 16 and divider 60 is tertiary air duct generally designated by reference numeral 76. Tertiary air duct 76 feeds conduits 78 formed in cover 16 and through outlets 80 as seen in FIG. 2. Finally, the combustion gases exit from opening 82 formed in the top of cover 16 and may then be used for drying.

In operation, fuel 40 is fed by means of screw conveyor 38 to top wall 32 as shown in FIG. 2. Primary air is provided through conduits or vents 44 formed in top wall 32 and which vents are designed to impart a cyclonic motion to the combustion gases as fuel 40 is consumed. Additionally, primary combustion air may be fed through conduits 72. As previously mentioned, both sources of primary air may be used together or alternatively, only one such source may be utilized at any one time.

The cyclonic motion given to the combustion gases is continued by means of the secondary air fed through conduits 68. This cyclonic motion provides for a greater residence time of the combustion gases and permits a more complete combustion.

It has also been found that the ashes resulting from the combustion of fuel 40, due to the nature of sloping top wall 32, tend to gradually move to the edge of the top wall and pass through gap 34 to deposit as an ash residue 75 on floor 12.

Figure 8:
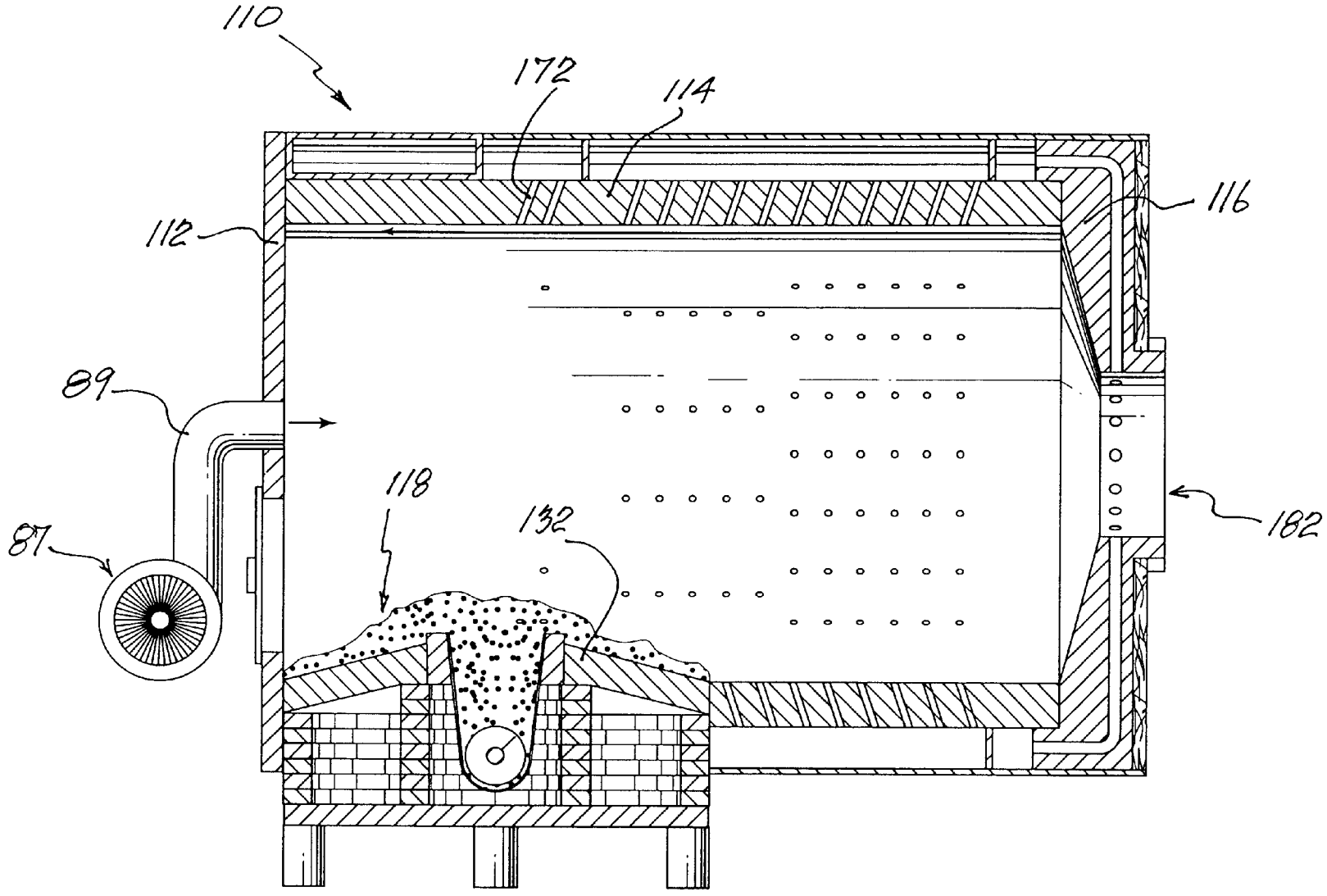
FIG. 8 is a cross sectional view of a further embodiment of an oven according to the present invention.

In the embodiment of FIG. 8, a structure somewhat similar to that previously described is shown with the difference being that the oven is placed on the horizontal. Similar reference numerals in the 100s are used for similar components. In this arrangement, there is provided a blower generally designated by reference numeral 87 designed to feed a conduit 89 to provide air to one end of oven 110.

Thus, as seen in FIG. 8, there is provided a base 112 having a side wall 114 extending therefrom. A cover 116 is provided at the other end while fuel support member 118 is mounted within a portion of side wall 114. In this arrangement, the cyclonic motion of the combustion gases can be achieved by the flow of the primary air through top wall 132 as well as by direction through primary air conduits 172. Using this arrangement, the combustion gases exit through opening 82 in cover 116 and may be directed to the dryer.

It will be understood that the above described embodiments are for purposes of illustration only and that changes and modifications may be made thereto without departing from the spirit and scope of the invention.

I claim:

1. An oven comprising a floor, an oven side wall extending upwardly therefrom to define a combustion chamber, and a top having an opening for combustion gases;

a fuel support member for receiving fuel mounted in a lower part of said combustion chamber, said fuel support member having a raised central portion, a downwardly and outwardly sloping top surface extending from said raised central portion;

means for feeding fuel to said fuel support member;

means for providing primary air to said fuel on said fuel support member; and means for providing secondary air to an upper portion of said combustion chamber, said means for providing secondary air being arranged to impart a cyclonic motion to said combustion gases.

2. The oven of claim 1 wherein said means for providing secondary air comprises a plurality of tangential conduits formed in said oven side wall.

3. The oven of claim 2 wherein said tangential conduits extend from an outer surface of said oven side wall to an inner surface thereof surrounding said combustion chamber, said conduits being angled downwardly from said outer surface of said oven side wall to said inner surface of said oven side wall.

4. The oven of claim 1 wherein said means for providing primary air to said fuel on said fuel support member comprises means arranged to impart a cyclonic motion to said combustion gases.

5. The oven of claim 4 wherein said means to impart a cyclonic motion to said combustion gases comprises a plurality of conduits formed in a top wall of said fuel support member, said conduits being angled with respect to a vertical plane.

6. The oven of claim 4 wherein said primary air is provided through a plurality of tangential conduits in said oven side wall proximate to said base.

7. The oven of claim 1 wherein said means for feeding fuel to said fuel support member comprises conveyor means extending transversely across said fuel support member.

8. The oven of claim 1 wherein said outwardly and downwardly sloping top surface of said fuel support member terminates short of said oven side wall to thereby provide a gap between said fuel support member and said oven side wall to permit ashes to fall through said gap.

9. The oven of claim 7 wherein said conveyor means comprises a conduit having a screw conveyor therein.

10. The oven of claim 1 further including an outer wall surrounding said oven side wall, said outer wall being spaced from said oven side wall, and dividers to form air ducts between said outer wall and said oven side wall.

11. The oven of claim 10 wherein said top includes conduits formed therein to provide tertiary air at an upper portion of said combustion chamber.

12. A method of providing complete combustion of a fuel and generating combustion gases suitable for drying a product, the method comprising the steps of providing an oven having a floor, an oven side wall extending upwardly from said floor to define a combustion chamber, and a top, the oven having a fuel support member mounted in a lower part of said combustion chamber, said fuel support member having a raised central portion and downwardly and outwardly sloping top surface extending from said raised central portion, and supplying primary air to fuel mounted on said fuel support member, providing secondary air in a cyclonic configuration to an upper portion of said combustion chamber.

* * * * *